United States Patent [19]

Hendricks

[11] Patent Number: 4,920,835

[45] Date of Patent: May 1, 1990

[54] WRENCH FOR REMOVAL OF DOUBLE NUT ASSEMBLY

[76] Inventor: Donald R. Hendricks, 2272 E. 34th, Tulsa, Okla. 74105

[21] Appl. No.: 227,629

[22] Filed: Aug. 2, 1988

Related U.S. Application Data

[63] Continuation-in-part of Ser. No. 108,942, Oct. 16, 1987, abandoned.

[51] Int. Cl.[5] ..... B25B 23/08

[52] U.S. Cl. ..... 81/462; 81/13

[58] Field of Search ..... 81/462, 13, 55, 57.4; 7/100; 269/95–96, 47–48, 254 CS

[56] References Cited

U.S. PATENT DOCUMENTS 2,305,274 12/1942 Power ..... 81/13

4,364,288 12/1982 Castoe ..... 81/55 X

*Primary Examiner*—D. S. Meislin

*Attorney, Agent, or Firm*—Bill D. McCarthy

[57] ABSTRACT

A wrench assembly for use in combination with a lug wrench for removing a stud-nut of a double nut assembly from an outer nut, the wrench comprising a wrench member having a nut-receiving opening formed in one end thereof adapted to engage the outer nut; and a retention assembly connectable to a wheel mount so as to stabilize the wrench member on the outer nut and prevent the outer nut from rotating when torque is applied to the stud-nut.

16 Claims, 3 Drawing Sheets

WRENCH FOR REMOVAL OF DOUBLE NUT ASSEMBLY

REFERENCE TO RELATED APPLICATION

This application is a continuation-in-part to my copending application U.S. Ser. No. 108,942, entitled "Stud Removal Tool", filed Oct. 16, 1987 now abandoned.

BACKGROUND OF THE INVENTION

1. Field of the Invention

The present invention relates to a wrench assembly for use in combination with a lug wrench for removal of a stud-nut from an outer nut of a double nut assembly used to secure a wheel mount to a hub of the vehicle.

2. Discussion of Prior Art

Dual wheel assemblies are commonly used on trucks to improve tire wear and fuel economy, as well as to reduce vibration and thus provide a smoother ride. The inner and outer wheel mounts of a dual wheel assembly are secured to a circular arrangement of threaded studs of a vehicle's axle hub by a multiple hole, double cap nut mounting system. A double nut assembly is supported by each of the threaded studs, with each double nut assembly including an inner nut and an outer nut. The inner nut, also referred to as a stud-nut, is a square-headed member having an internal threaded bore and external threads, and is threaded onto one of the threaded studs of the axle hub to secure the inner wheel mount. The outer nut is threaded onto the stud-nut to secure the outer wheel mount.

The unique arrangement of the double nut assemblies permits the removal of the wheel assemblies from the vehicle's axle hub using a lug wrench, such as a pneumatic wrench. However, problems often arise in the removal of the stud-nut from the outer nut of the double nut assembly which may be connected to the wheel mount of the outer wheel assembly of the vehicle. That is, water, dirt and salt often cause the outer nut and the nut-stud to become "frozen" which requires special procedures for removal, and thus can lead to potential damage to the wheel mount, as well as the stud-nut and/or outer nut.

To assist in the removal of the stud-nut from the outer nut of the double nut assembly a nut wrench was developed. This prior art nut wrench consists of a wrench body having at one end a hexagonal opening and a perpendicularly extending extension at the opposed end thereof. The hexagonal opening of the body is adapted to be placed about the outer nut of the double nut assembly, and the extension at the opposite end thereof to be placed within a stud-receiving opening in the wheel mount (which does not contain a double nut assembly) or adjacent a portion of a rim of the wheel mount. The nut wrench of the prior art is designed to hold or secure the outer nut of the double nut assembly so as to prevent rotation of the outer nut when a wrench is used to remove the stud-nut therefrom.

The nut wrench of the prior art described above can be highly dangerous to the user. For example, in utilizing the prior art nut wrench the user must hold or press the nut wrench against the wheel mount to maintain the extension member of the wrench within the stud-receiving opening of the wheel mount or adjacent the rim of the wheel mount. Because of the torque generated when pneumatic wrenches are used to remove the stud-nut from the outer nut of the double nut assembly, the user cannot always maintain the prior art wrench in place, resulting in potential injury to the user, damage to the stud-nut of the double nut assembly (such as shearing) and damage to the wheel mount created by rotation of the wrench.

Thus, while the prior art wrench has met with some success, the need still remains for an inexpensive, durable wrench which can be used in combination with a lug wrench, such as a pneumatic wrench, to remove the stud-nut from the outer nut of the double nut assembly without requiring the user to support such wrench against the wheel mount with the user's hand or foot; and which does not inadvertently dislodge from contact with the wheel mount and thereby spin due to torque generated by a pneumatic wrench when a pneumatic wrench is employed to remove the stud-nut from the outer nut of the double nut assembly. It is to such a wrench assembly that the subject invention is directed.

SUMMARY OF THE INVENTION

According to the present invention an improved wrench assembly is provided which, when positioned in a secured portion on a rim portion of a wheel mount, enables one to employ a pneumatic lug wrench to safely and efficiently remove a stud-nut from an outer nut of a double nut assembly. The wrench assembly, which is secured in a stable position to the rim portion of the wheel mount, comprises a wrench member having a nut-receiving opening adapted to engage the outer nut of the double nut assembly, and a retention assembly for securing the wrench member to the rim of the wheel mount such that the wrench member is retained in a stable, outer nut engaging position when torque is applied to the stud-nut.

The wrench member is supported by and extends from the retention assembly such that, when the retention assembly is disposed within the hub-receiving opening of the wheel mount and secured to the rim thereof, the wrench member engages an adjacently disposed outer nut of the double nut assembly. The nut-receiving opening in the wrench member is provided with a configuration substantially corresponding to the circumferential configuration of the outer nut of the double nut assembly.

An object of the present invention is to provide a wrench assembly for removing a stud-nut from an outer nut of a double nut assembly.

Another object of the present invention, while achieving the before-stated object, is to provide a wrench assembly which will enable one to safely and efficiently remove a stud-nut from an outer nut secured or "frozen" to a wheel mount without requiring one to stabilize the wrench on the wheel mount with one's hand or foot.

Yet another object of the present invention, while achieving the before-stated objects, is to provide a wrench assembly for use in combination with a pneumatic lug wrench adapted to remove a stud-nut from an outer nut "frozen" on a wheel mount which is durable in construction, economic to manufacture and which overcomes the disadvantages of the prior art wrench.

Other objects, advantages and features of the present invention will become apparent from the following description when read in conjunction with the drawings and appended claims.

DETAILED DESCRIPTION

Figure 1:
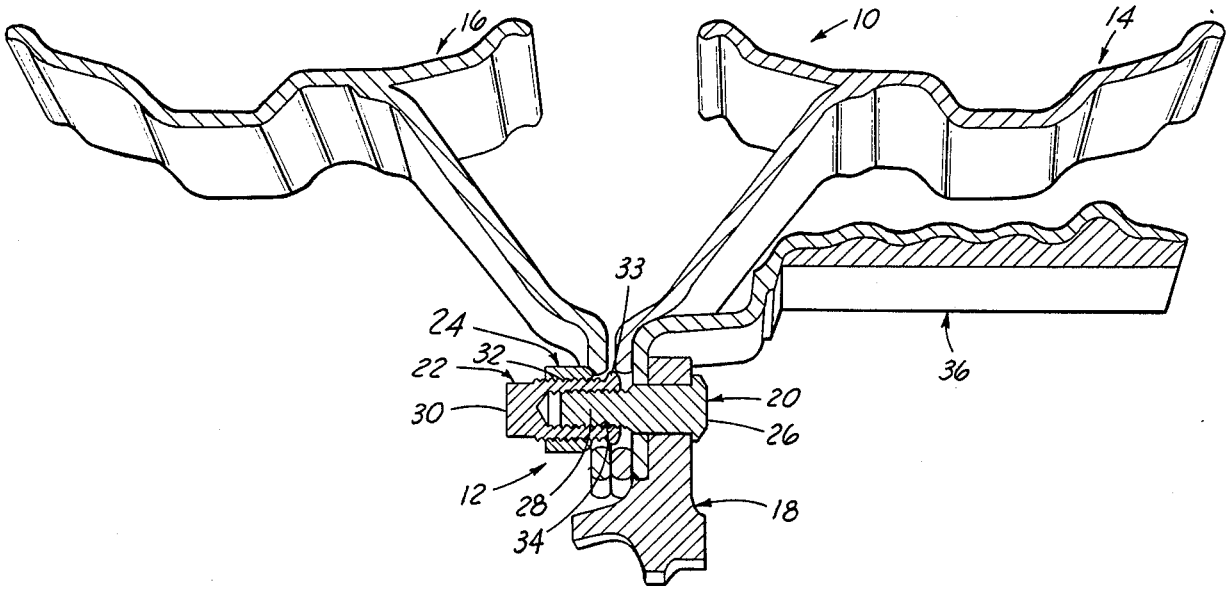
FIG. 1 is a perspective, cut-away view of a portion of a conventional disc wheel system wherein dual wheels (inner and outer wheels) are secured to the studs of an axle hub of a vehicle by plural double nut assemblies.

Referring now to the drawings, and more particularly to FIG. 1, a disc wheel assembly 10 is illustrated wherein a plurality of double nut assemblies 12 are employed to mount an inner wheel mount 14 and an outer wheel mount 16 to an axle hub 18 of a vehicle (not shown). Each double nut assembly 12 functions as a lug nut for threading engagement with a stud 20 which extends from the axle hub 18. Only one double nut assembly 12 is shown in FIG. 1 and comprises an inner nut 22 (hereinafter referred to as stud-nut 22) and an outer nut 24. The stud 20 and the stud-nut 22 cooperate to secure the inner wheel mount 14 to the axle hub 18; whereas, the stud-nut 22 and the outer nut 24 cooperate with the stud 20 to secure the outer wheel mount 16 to the axle hub 18.

Figure 2:
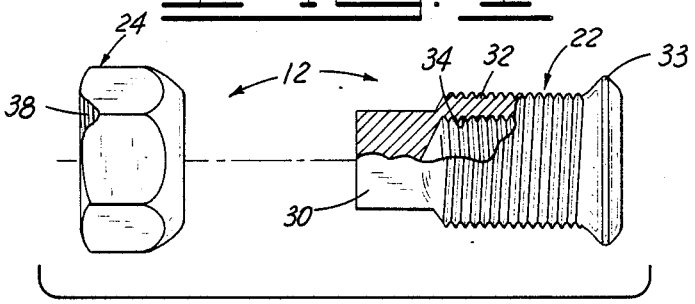
FIG. 2 is an exploded, partially cut-away, elevational view of a stud-nut (inner nut) and an outer nut of one of the double nut assemblies.

The stud 20 is characterized as having a head or first end 26 and a threaded second end portion 28; whereas the stud-nut 22 is characterized as having square-shaped first end portion 30 and a cylindrical-shaped, externally threaded second end portion 32 having a flared distal end 33 substantially as shown in FIG. 2. The externally threaded second end portion 32 of the stud-nut 22 is also provided with an internal threaded bore 34. Thus, the threaded end portion 28 of the stud 20 extends outwardly from the hub axle 18 for mating engagement with the internal threaded bore 34 of the stud-nut 22 to secure the inner wheel mount 14 and a brake drum 36 to the axle hub 18 substantially as shown in FIG. 1.

As previously stated, the stud-nut 22 and the outer nut 24 cooperate to secure the outer wheel mount 16 to the axle hub 18. Thus, the external threads on the cylindrical-shaped second end portion 32 of the stud-nut 22 are adapted to matingly engage internal threads 38 of the outer nut 24.

The interconnection of the stud 20, and the stud-nut 22 and the outer nut 24 of the double nut assembly 12 enables one to operably connect the inner and outer wheel mounts 14, 16 to the axle hub 18 of a vehicle (not shown). When it is desired to remove the inner and outer wheel mounts 14, 16 (and thus the tires supported thereon) from the axle hub 18 of the vehicle for maintenance or replacement, the inner and outer wheel mounts 14, 16 can be removed by applying a torque to the outer nut 24 such that the outer nut 24 is rotated and removed from its supporting stud-nut 22. When all of the double nut assemblies 12 have the outer nuts 24 removed, the outer wheel mount 16 can be removed. Then with removal of the stud-nuts 22 from the supporting studs 20, the inner wheel mount 14 can be removed.

While the above-described removal procedure is the intended one, problems often occur because of the tendency of the outer nut 24 to "freeze" to the stud-nut 22 during usage of the vehicle. In such instances, one or more of the double nut assemblies 12 can remain connected to the outer wheel mount 16. When this happens, these double nut assemblies 12 must be removed from the outer wheel mount 16 before it can be properly remounted to the axle hub 18. That is, in the normal remounting procedure, the inner wheel mount 14 should just be mounted to the studs 20 and firmly secured thereto via the stud-nuts 22 appropriately tightened. Once these are in place, the outer wheel mount 16 can be mounted by disposing same such that the stud-nuts 22 extend through the holes thereof and are secured thereto via the outer nuts 24 appropriately tightened on the stud-nuts 22. This procedure requires that the outer wheel mount 16 be freed of any of the double nut assemblies 12 which might remain thereon during dismounting.

Figure 3:
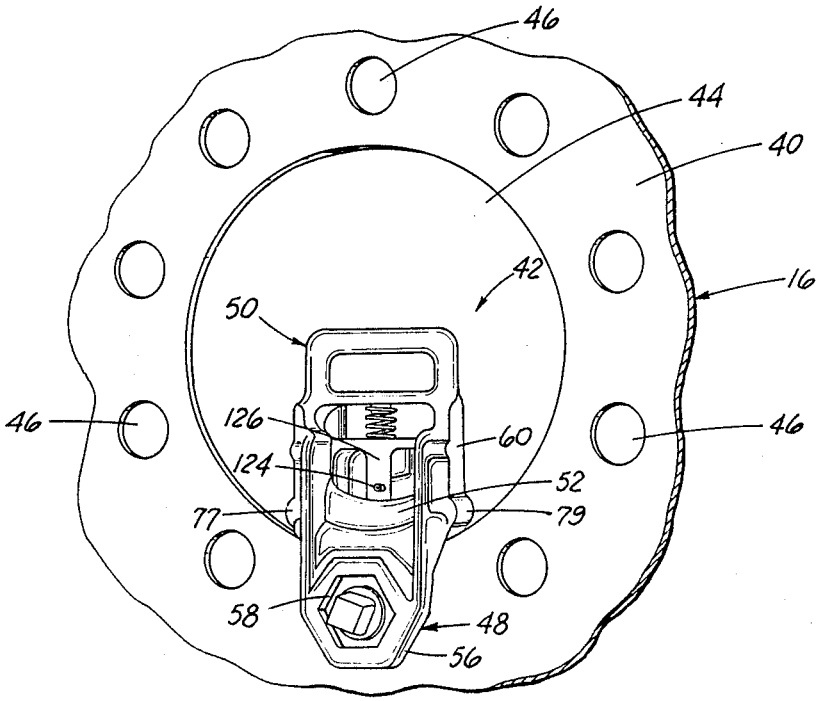
FIG. 3 is a fragmental isometric view of one side of a wheel mount which has been removed from the axle hub of a vehicle and illustrating a wrench assembly of the present invention secured to a rim portion of the wheel mount so as to engage an outer nut of a double nut assembly.
Figure 4:
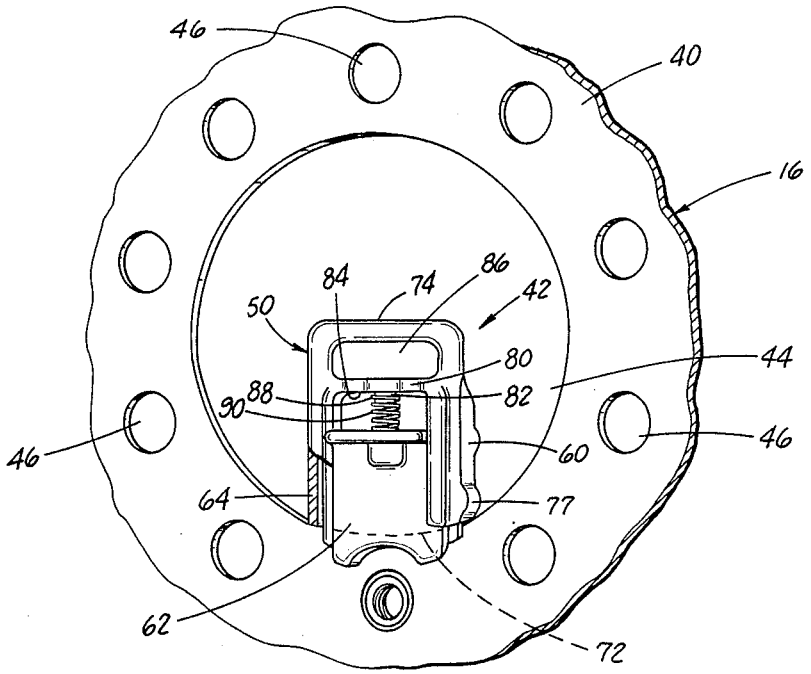
FIG. 4 is a fragmental isometric view of an opposed side of the wheel mount of FIG. 3 and illustrating the connection of the wrench assembly to a rim portion of the wheel mount.

FIGS. 3 and 4 show a rim portion 40 of the outer wheel mount 16 having one of the double nut assemblies 12 retained thereon after the outer wheel mount 16 has been dismounted. To prevent damage to the double nut assembly 12, and to the outer wheel mount 16 (particularly to the rim portion 40 thereof) during the removal of the double nut assembly 12 therefrom, a wrench assembly 42, constructed in accordance with the present invention, is employed for stabilizing the outer nut 24 so that the stud-nut 22 can be removed therefrom by the application of torque. To stabilize the outer nut 24, the wrench assembly 42 is supported on the rim portion 40 of the outer wheel mount 16 substantially as shown in FIGS. 3 and 4.

It should be understood that when employing the wrench assembly 42 to remove the double nut assembly 12 from the outer wheel mount 16, the outer wheel mount 16 has been removed from the axle hub of the vehicle so that a hub opening 44 provided in the rim portion 40 is open and unrestricted. As shown, the rim portion 40 is provided with a plurality of equally spaced stud-receiving openings 46 disposed about the hub opening 44.

Figure 5:
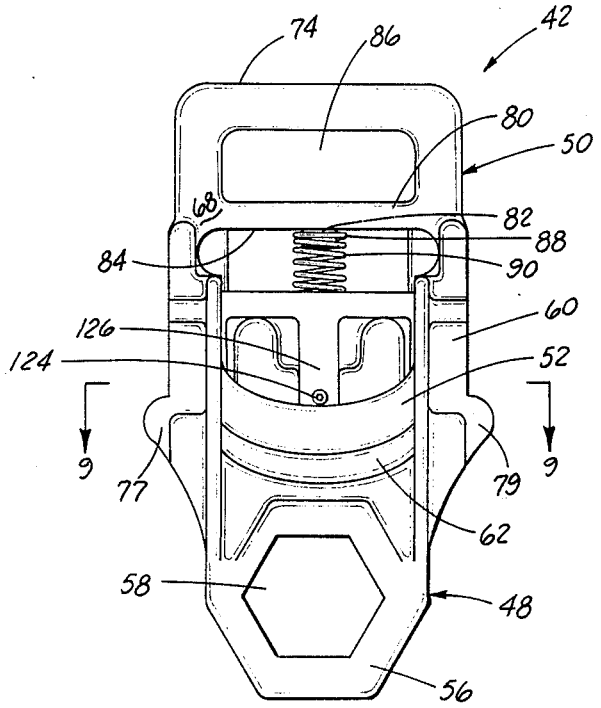
FIG. 5 is a bottom plan view of the wrench assembly of FIG. 3 having a tongue member of a retention assembly in an extended position.
Figure 6:
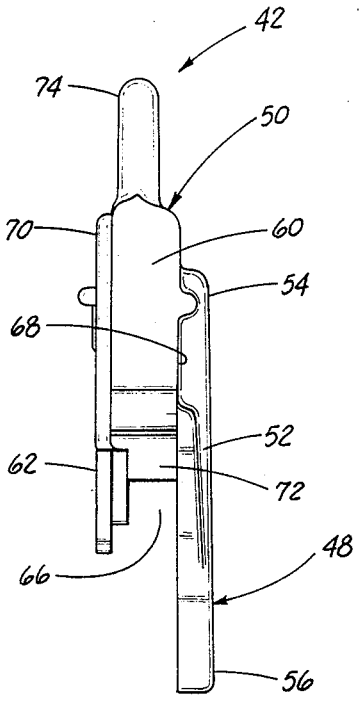
FIG. 6 is a side elevational view of the wrench assembly of FIG . 5.

The wrench assembly 42 is designed for use with a pneumatic wrench (not shown) to remove the stud-nut 22 from the outer nut 24 of the double nut assembly 12 which is "frozen" in one of the stud-receiving openings 46 of the outer wheel mount 16 so that the wheel mount 16, after repair or replacement of the tire supported thereon, can again be positioned on the axle hub 18 and secured thereto via the studs 20 and the double nut assemblies 12. The wrench assembly 42 comprises a wrench member 48 supported by a retention assembly 50 such that the wrench member 48 extends therefrom substantially as shown in FIG. 5 and 6. Thus, when the retention assembly 50 is positioned within the hub opening 44 of the outer wheel mount 16 and stabilized on the rim portion 40 thereof, the wrench member 48 engages the outer nut 24 of the double nut assembly 12 and prevents same from rotating when torque is applied to the stud nut 22.

The wrench member 48 comprises a wrench body 52 having a first end portion 54 and an opposed second or distal end portion 56. The distal end portion 56 is provided with a nut-receiving opening 58 therein for permitting the wrench member 48 to engage and stabilize the outer nut 24. The nut-receiving opening 58 is desirably provided with a configuration corresponding to the circumferential configuration of the outer nut 24. That is, if the outer nut has a hexagonal configuration the nut-receiving opening 58 is also provided with a hexagonal configuration. Further, the nut-receiving opening 58 is provided with a size or dimension so that when the outer nut 24 is positioned within the nut-receiving opening 58 and torque is applied to the stud-nut 22, the wrench member 48 prevents the outer nut 24 from rotating.

The wrench member 48 can be fabricated as a separate component, in which case the first end portion 54 is secured to a body member 60 of the retention assembly 50 such that the distal end portion 56 of the wrench body 52 extends from the body member 60; or the wrench member 48 can be integrally formed with the body member 60 of the retention assembly 50. Further, the wrench body 52 (which is rigidly supported by the body member 60 of the retention assembly 50) can also be pivotally connected to the retention assembly 50 so as to permit the wrench member 48 to be rotated several degrees to facilitate its attachment to the outer nut 24 of the double nut assembly 12.

The retention assembly 50 comprises the body member 60 and a tongue member 62. The tongue member 62 is slideably retained in a tongue retaining groove 64 of the body member 60 such that the tongue member 62 is selectively movable between an extended position and a retracted position. In the extended position the tongue member 62 is disposed in a spatial relationship with the wrench body 52 of the wrench member 48 such that a rim receiving slot 66 is formed therebetween (FIG. 6); whereas, in the retracted position the tongue member 62 is moved toward the body member 60 of the retention assembly 50 so that the wrench assembly 42 can be disposed on or removed from the rim portion 40 of the outer wheel mount 16.

Figure 7:
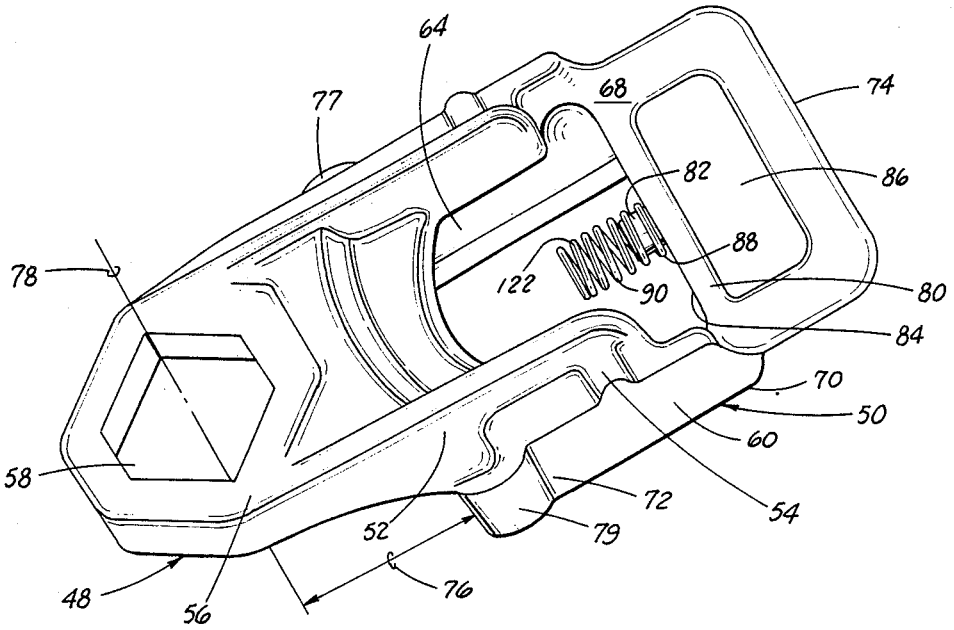
FIG. 7 is an isometric view of a body portion of the retention assembly of the wrench assembly of FIG. 5 and illustrating spatially disposed tracks for slideably receiving a tongue member such that the tongue member can be selectively moved between the extended position and a retracted position.

The body member 60, a substantially planar member, is provided with an upper side 68, a lower side 70, a first end 72 and an opposed second end 74. The wrench body 52 is secured to and supported by the upper side 68 of the body member 60 such that the distal end portion 56 of the wrench body 52 (which contains the nut-receiving opening 58 therein) extends therefrom substantially as shown in FIG. 7. The distance 76 between the first end 72 of the body member 60 and a central axis 78 of the nut-receiving opening 58 is at least equal to the distance between the rim portion 40 of the outer wheel mount 16 defining the hub opening 44 and a central axis of an adjacently disposed stud-receiving opening. Further, the first end 72 of the body member 60 of the retention assembly 50 (shown in phantom in FIG. 4) is provided with an arcuate configuration substantially corresponding to the arcuate configuration of the hub opening 44 in the rim portion 40.

To assist in stabilizing the body member 60 of the retention assembly 50 on the rim portion 40 of the outer wheel mount 16, the body member 60 is further provided with projecting ears or extension members 77 and 79 which are supported by the body member 60 so as to be aligned with the first end 72 thereof. The extension members 77 and 79 are each provided with an arcuate-shaped forward side or surface so that the extension members 77 and 79 cooperate to extend or enlarge the arcuate-shaped surface of the first end 72 of the body member 60. Thus, the extension members 77 and 79 cooperate with the first end 72 of the body member 60 to provide an enlarge surface for abutting the rim portion 40 when the wrench assembly 42 is positioned thereon, and thus increase the stability of the wrench assembly 42.

The body member 60 of the retention assembly 50 further comprises a cross brace member 80 spatially disposed from the second end 74 of the body member 60, and a spring support member 82 extending from a lower side 84 of the cross brace member 80. The second end 74 of the body member 60 and the cross brace member 80 define a hand-receiving opening 86 therebetween, the hand-receiving opening 86 permitting one to easily carry the wrench assembly 42, as well as permitting one to grasp the second end 74 of the body member 60 to stabilize the wrench assembly 42 when placing same in a rim engaging position or removing same therefrom.

The spring support member 82, a cylindrical-shaped extension member, is configured to receive one end 88 of a spring member 90. The spring member 90, which is also connected to the tongue member 62, biases the tongue member 62 in the extended position.

Figure 9:
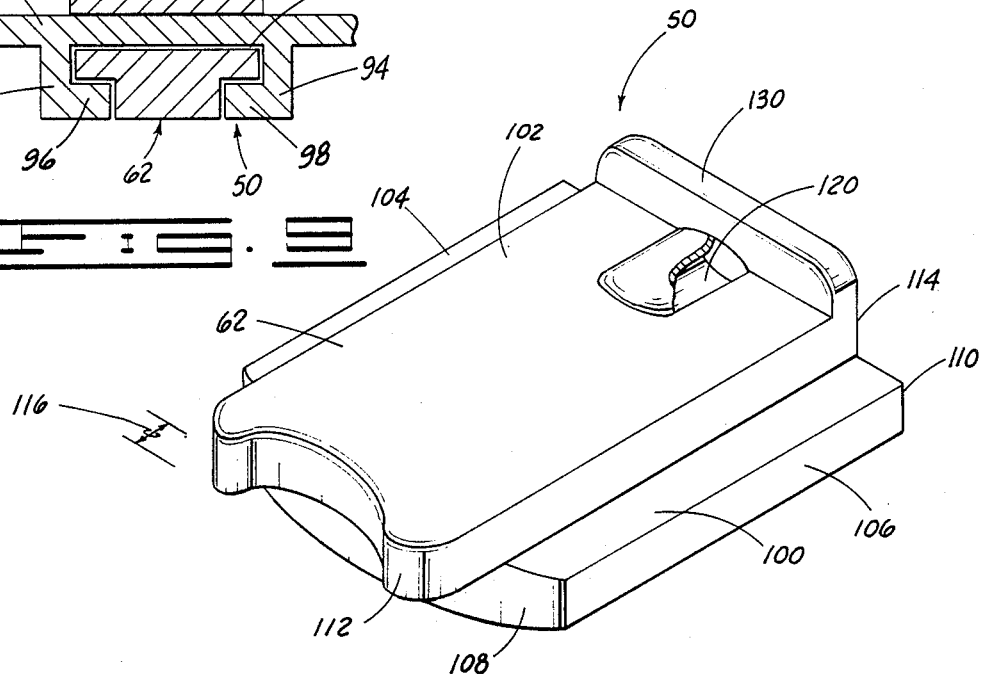
FIG. 9 is a fragmental cross-section view of the wrench assembly of FIG. 5 taken along the lines 9—9.

As previously stated, the tongue member 62 is retained in the tongue retaining groove 64 of the body member 60 so that the tongue member 62 is selectively movable between the extended position and the retracted position. As shown in FIGS. 4 and 9, the tongue retaining groove 64 is formed by parallel, spatially disposed guide brackets or members 92 and 94 supported by the lower side 70 of the body member 60. The guide members 92 and 94, which are disposed substantially normal to the elongated axis of the cross brace member 80, extends from the cross brace member 80 to the second end 74 of the body member 60. The guide members 92 and 94 are provided with a lip portion 96 and 98, respectively, so that a track for the tongue member 62 is formed by the body member 60 and the guide members 92 and 94.

The guide members 92 and 94 can be fabricated as separate elements and secured to the lower side 70 of the body member 60 by any suitable means, such as welding; or, more desirably, the guide members 92 and 94 and the body member 60 are integrally formed.

Figure 8:
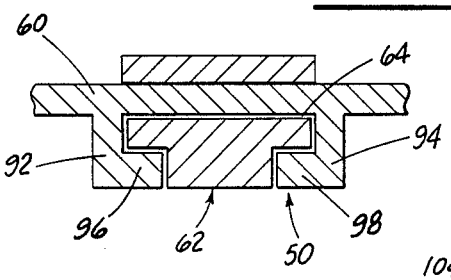
FIG. 8 is a partially cut-away, isometric view of the tongue member of the retention assembly of the wrench assembly of FIG. 5 and illustrating a spring-receiving bore formed in one end of the tongue member.

As more clearly shown in FIG. 8, the tongue member 62 is a substantially planar member having a lower portion 100 and an upper portion 102. The lower portion 100 has a width less than the width of the tongue retaining groove 64 formed on the lower side 70 of the body member 60; and the upper portion 102 is provided with a width less than the distance between the lip portions 96 and 98 of the guide brackets 92, 94, respectively, substantially as shown in FIG. 9. Thus, the tongue member 62 is retained in the tongue retaining groove 64 by ears or guide members 104 and 106 formed along the longitudinally extending sides of the lower portion 100.

The lower portion 100 of the tongue member 62 is provided with a first end 108 and an opposed second end 110; and the upper portion 102 thereof is also provided with a first end 112 and an opposed second end 114. The lower portion 100 is provided with a length less than the length of the upper portion 102 such that the first end 108 of the lower portion 100 terminates a distance 116 from the first end 112 of the upper portion 102 substantially as shown in FIG. 8. Thus, the upper portion 102 of the tongue member 62 extends beyond the lower portion 100 thereof and cooperates with the wrench body 52 to define the rim receiving slot 66.

To assist in stabilizing the wrench assembly 42 on the rim portion 40 of the outer wheel mount 16, the first end 108 of the lower portion 100 (which may abut the rim portion 40 depending upon the thickness of the rim portion 40 of the outer wheel mount 16) is provided with an arcuate-shaped configuration substantially corresponding to the arcuate-shape of the portion of the rim defining the hub opening 44. On the other hand, the first end 112 of the upper portion 102 (which is disposed adjacent a lower or underside of the outer wheel mount 16) is provided with a concave surface so that the upper portion 102 does not contact or interfere with the removal of the stud-nut 22 of the double nut assembly 12.

A spring retaining bore 120 is formed in the second ends 110, 114 of the lower and upper portion 100, 102, respectively. The spring retaining bore 120 is aligned with the spring support member 82 of the cross brace member 80; and the spring retaining bore 120 is adapted to receive a second end 122 of the spring member 80.

As previously stated, the spring member 80, which is disposed between and connected to the lower side 84 of the cross brace member 80 and the second ends 110, 114 of the lower and upper portions 100, 102 of the tongue member 62, biases the tongue member 62 in the extended position. To prevent the tongue member 62 from disengaging the track defined by the guide brackets 92, 94 and the body member 60 of the retainer assembly 50, the wrench assembly 42 further comprises a stop member 124 connectable to a lower side 126 of the lower portion 100 of the tongue member 62 a distance from the second end 110 thereof. The distance that the stop member 124 is disposed from the second end 110 of the lower portion 100 will determine the longitudinal movement of the tongue member 62 in the extended position, and thus define the depth of the rim receiving slot 66 formed between the tongue member 62 and the wrench body 52. That is, the stop member 124 engages the body member 60 of the retention assembly 50 and prevents further movement of the tongue member 62 through the tongue retaining groove 64 as the tongue member 62 is biased in the extended position by the spring member 90.

To assist one in the movement of the tongue member 62 from the biased, extended position to the retracted position (as required to position the wrench assembly 42 on the rim portion 40 of the outer wheel mount 16 or to remove same therefrom), the tongue member 62 further comprises a substantially vertically disposed gripping member 130 disposed adjacent the second end 114 of the upper portion 102 substantially as shown in FIG. 8. The gripping member 130, as well as the lower and upper portions 100, 102 of the tongue member 62, can be fabricated as separate elements and secured together by any suitable means, such as welding; or, and more desirably, the gripping member 130 and the lower and upper portions 100, 102 are fabricated of unitary construction so that the tongue member 62 is integrally formed.

To employ the wrench assembly 42 to remove the outer nut 24 from the stud-nut 22 of the double nut assembly 12, which has remained in one of the stud-receiving openings 46 of the outer wheel mount 16, the following procedure is employed. However it should be understood that when employing the wrench assembly 42 of the present invention to remove the outer nut 24 from the stud-nut 22, the outer wheel mount 16 has previously been removed from the axle hub 18 of the vehicle.

When it is determined that it is necessary to employ the wrench assembly 42 to remove the outer nut 24 from the stud-nut 22, the user grasps the gripping member 130 of the tongue member 62 and "squeezes" the gripping member 130 against the opposed second end 74 of the body member 60 of the retention assembly 50. This squeezing action moves the tongue member 62 to its retracted position. Thereafter, the nut-receiving opening 58 in the distal end 56 of the wrench body 52 is positioned over the outer nut 24 and the first end 72 of the body member 60 is disposed substantially adjacent the rim portion 40 of the outer wheel mount 16 such that the rim portion 40 is aligned with the rim receiving slot 66. The gripping member 130 is then released which permits the tongue member 62 to move to the extended position so that the first end 112 of the upper portion 102 of the tongue member 62 is disposed adjacent an underside of the rim portion 40 of the outer wheel mount 16, and thus the wrench assembly 42 is stabilized thereon. When the wrench assembly 42 is stabilized on the rim portion 40 of the outer wheel mount 16, the wrench member 48 engages the outer nut 24 and thereby prevents same from rotating when torque is applied to the stud-nut 22.

Once the outer nut 24 has been removed from the stud-nut 22, the wrench assembly 42 can be removed from the rim portion 40 of the outer wheel mount 16 by grasping the gripping member 130 and squeezing same against the opposed second end 74 of the body member 60 of the retention assembly 50. This squeezing action moves the tongue member 62 to its retracted position so that the wrench assembly 42 can be removed from the rim portion 40 of the outer wheel mount 16.

It is clear that the present invention is well adapted to carry out the objects and attain the ends and advantages mentioned therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A wrench assembly for use with a lug wrench to remove a stud-nut and an outer nut of a double nut assembly from a wheel mount, the wheel mount having an unrestricted hub opening in a rim portion thereof, the wrench assembly comprising:

a wrench member having a nut receiving opening formed therein for engaging the outer nut of the double nut assembly; and retention means for selectively securing the wrench member to the rim portion of the wheel mount so that the wrench member is retained in a stationary outer nut engaging position when torque is applied to the stud-nut, the retention means comprising:

a substantially planar body member having an upper side and a lower side, the body member positionable within the hub opening of the wheel mount so as to be disposed substantially adjacent the rim portion, the wrench member connected to the body member such that the nut receiving opening is disposed a distance from the body member;

tongue means supported by the body member for stabilizing the body member, the tongue means having a tongue member which engages the rim portion when the outer nut is positioned within the nut receiving opening of the wrench member; and, track means supported on the lower side of the body member for slideably retaining the tongue member and for permitting the tongue member to be selectively moved between an extended wheel mount engaging position and a retracted position.

2. The wrench assembly of claim 1 wherein the wrench member is supported on the upper side of the body member, the tongue member is supported on the lower side of the body member, the wrench member and tongue member cooperating to define a rim receiving slot therebetween such that in the extended position the tongue member engages an underside of the portion of the rim defining the hub opening and in the retracted position the tongue member is disposed substantially adjacent the body member so that the body member is permitted to be positioned on and removed from the rim.

3. The wrench assembly of claim 2 wherein the tongue member is a substantially planar member having an upper portion and a lower portion, the upper portion having a width less than the width of the lower portion such that the lower portion is provided with longitudinally extending extension members which are disposable in the track means.

4. The wrench assembly of claim 3 wherein the lower and upper portions of the tongue member are each characterized as having a first end, the first end of the lower portion terminating a distance from the first end of the upper portion such that when the wrench assembly is connected to the rim of the wheel mount and the tongue member is in the extended position the lower portion of the tongue member abuts the rim and the upper portion engages and overlaps a portion of the rim.

5. The wrench assembly of claim 4 wherein the first end of the lower portion is provided with an arcuate configuration and wherein the first end of the upper portion is provided with a concave configuration.

6. The wrench assembly of claim 1 further comprising biasing means for biasing the tongue member in the extended position.

7. The wrench assembly of claim 6 further comprising stop means supported by the tongue member for engaging the body member of the body assembly and thereby restricting the movement of the tongue member in the biased extended position.

8. The wrench assembly of claim 7 wherein the track means comprises parallel, spatially disposed bracket members, the bracket members providing tongue retaining groove means for stabilizing the tongue member on the planar body member and for permitting the tongue member to be selectively moved between the extended position and the retracted position.

9. The wrench assembly of claim 7 wherein the biasing means comprises a spring member having a first end and an opposed second end, the first end connected to the planar body member, the opposed second end connected to the tongue member.

10. A wrench assembly for securing an outer nut of a double nut assembly so that an inner stud-nut of the double nut assembly can be removed from a wheel mount having a rim defining a hub opening therein, the wrench assembly comprising:

a wrench member having a nut-receiving opening formed in one end thereof; and retention means for selectively securing the wrench member to the rim of the wheel mount such that the wrench member engages the outer nut of the double nut assembly and prevents same from rotating when torque is applied to the inner stud-nut, the retention means comprising:

a substantially planar body member having an upper side and a lower side, the wrench member connected to the upper side of the body member such that the end containing the nut-receiving opening extends therefrom;

a track assembly supported on the lower side of the body member; and a tongue member slideably retained in the track assembly so as to be movable between an extended rim engaging position and a retracted position.

11. The wrench assembly of claim 10 wherein the wrench member and the tongue member cooperate to define rim receiving slot therebetween when the tongue member is in the extended position.

12. The wrench assembly of claim 10 further comprising biasing means disposed between the planar body member of the retention means and the tongue member for biasing the tongue member in the extended position.

13. The wrench assembly of claim 11 wherein the track assembly comprises:

parallel, spatially disposed bracket members, the bracket members cooperating with the planar body member to define a tongue retaining groove to slideably receive the tongue member.

14. The wrench assembly of claim 13 wherein the planar body member further comprises a cross brace member disposed a distance from one end thereof, the cross brace member and the end of the planar body member defining a hand-receiving opening therebetween, and wherein the wrench assembly further comprises:

biasing means disposed between the cross brace member and the tongue member for biasing the tongue member in the extended position.

15. The wrench assembly of claim 14 further comprising:

a substantially vertically disposed gripping member supported by the tongue member for permitting one to move the tongue member to the retracted position.

16. The wrench assembly of claim 15 further comprising:

stop means supported by the tongue member for engaging the planar body member and thereby restricting the movement of the tongue member in the biased, extended position.

* * * * *